United States Patent [19]

Henderson

[11] Patent Number: 4,805,696

[45] Date of Patent: Feb. 21, 1989

[54] HYDRAULIC RELEASE TUBING SEAL DIVIDER

[75] Inventor: William D. Henderson, Frisco, Tex.

[73] Assignee: Otis Engineering Corporation, Dallas, Tex.

[21] Appl. No.: 151,898

[22] Filed: Feb. 3, 1988

[51] Int. Cl.[4] ..... F21B 17/07; F21B 43/00; F16L 27/12

[52] U.S. Cl. ..... 166/114; 166/237; 166/387; 285/3; 285/86; 285/302

[58] Field of Search ..... 166/387, 380, 242, 237, 166/179; 175/321; 285/86, 302, 138, 139, 140, 2, 3, 4

[56] References Cited

U.S. PATENT DOCUMENTS

| | | | |
|---|---|---|---|
| 3,037,797 | 6/1962 | Brown | 285/18 |
| 3,288,493 | 11/1966 | Brown | 285/140 X |
| 4,281,858 | 8/1981 | Boyer | 285/302 X |
| 4,289,202 | 9/1981 | Henderson | 166/125 X |
| 4,423,889 | 1/1984 | Weise | 285/86 X |
| 4,433,725 | 2/1984 | Bowyer | 285/86 X |
| 4,693,316 | 9/1987 | Ringgenberg et al. | 285/302 X |

*Primary Examiner*—Stephen J. Novosad
*Attorney, Agent, or Firm*—Johnson & Swanson

[57] ABSTRACT

A hydraulic release tubing seal divider for connecting lower and upper tubing strings together in a wellbore, including an inner housing assembly connected with one of the tubing string and middle and outer housing assemblies connected with the other of the tubing strings, including hydraulically operable locking structure carried by the middle and outer housing assemblies for locking the tubing strings together while the strings are run into a well, and for hydraulically releasing the middle and outer housing assemblies from the inner housing assembly to permit relative telescopic movement in the well between the upper and lower tubing strings at the tubing seal divider.

12 Claims, 4 Drawing Sheets

HYDRAULIC RELEASE TUBING SEAL DIVIDER

Figure 1:
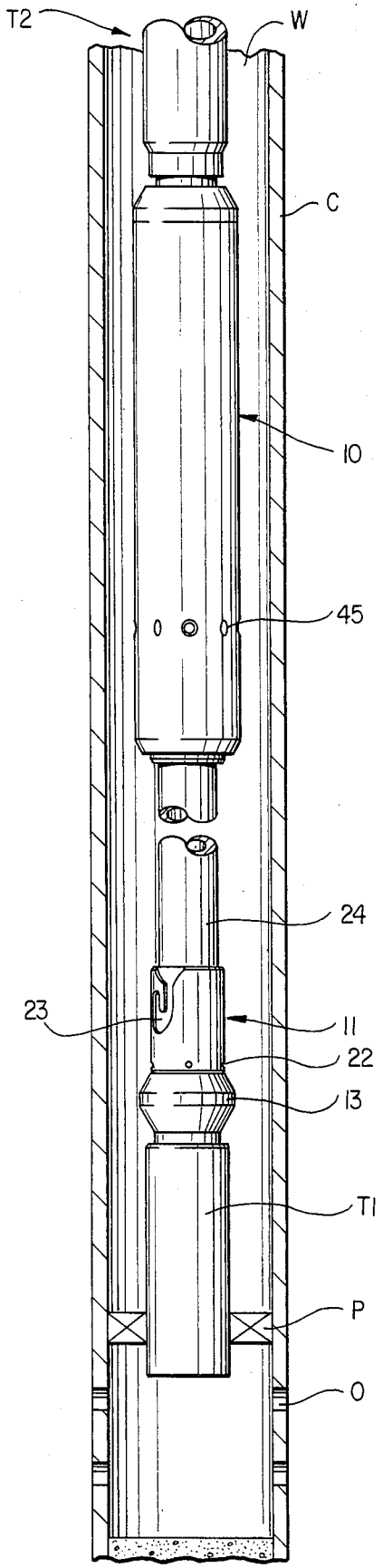

This invention relates to well tools, particularly tools for use with oil and gas well tubing strings, and more particularly relates to a hydraulic tubing seal divider for hydraulic release of an upper tubing string from a lower tubing string to permit spacing adjustments of the tubing string assembly from the wellhead to a packer in which the tubing string is connected.

Oil and gas wells are generally fitted with well bore casing, liner, and fluid production tubing strings for flowing petroleum oil and gas from an earth formation upwardly through the well bore to the surface. In such wells the tubing string or strings define the flow paths through which the well fluids may flow while the annulus space between the tubing string or strings and the well casing defines an additional flow path which may serve to conduct well fluids to the surface or may contain static liquids for maintaining a hydrostatic head in the well bore for well known control purposes. Generally, such wells are equipped with packers which seal between the well casing and the tubing string and the tubing string includes various flow control apparatus such as safety valves, gas lift valves, and the like. Various conditions may develop which make it desirable to remove the tubing string above the packer for servicing the valves, correcting corrosion problems, and solving other problems which may interfere with the operation of a well. When tubing strings are removed for such purposes, it is preferable that the upper portion of the tubing string above a packer be retrieved to the surface while temporarily plugging the tubing string at or above the packer temporarily while servicing the upper tubing string. Additionally, when such tubing strings are installed in an oil or gas well in conjunction with a packer, expansion and contraction may occur in an upper section of the tubing string extending between the wellhead and the packer. It is thus desirable to provide a tubing seal divider or expansion joint to relieve the tubing of stresses due to expansion or contraction such as may be caused by temperature changes or otherwise after the packer is set by allowing telescoped parts of the joint to move relative to each other. It may also be desirable for such an expansion joint to remain immobilized until after the packer is set in the well bore. This may be necessary for the joint to carry the weight of the tubing string when positioning the packer in the well and to allow a wellhead to be secured to the casing for production purposes as soon as possible after setting the packer. The various problems inherent in apparatus which permits removal of a tubing string above a packer and allows for tubing expansion between the packer and the wellhead have been addressed in various prior art patents. An expansion joint is disclosed in U.S. Pat. No. 4,423,889 issued to Stanley A. Weise, Jan. 3, 1984. In that patent an expansion joint is shown which is releasable in a well by wireline tools and techniques. Such a system, of course, requires the additional steps and expense of setting up wireline equipment on the well. Another apparatus of the tubing seal divider type is shown in U.S. Pat. No. 4,289,202 issued Sept. 15, 1981 to William D. Henderson. In that latter patent the tubing seal divider disclosed is hydraulically releasable in the well but the divider must be run in a closed condition so that it is capable only of expansion from the condition in which it is run with upper and lower tubing string sections in a well. Other expansion joints of the general nature of the present invention require tubing rotation to release the joint to function in the well bore.

It is a principal object of the invention to provide a new and improved apparatus for coupling upper and lower tubing strings together in a well bore.

It is another object of the invention to provide a new and improved well tubing string coupling apparatus of the tubing seal divider type.

It is another object of the invention to provide a tubing seal divider which does not require that the upper tubing string be rotated for disconnection from the lower tubing string.

It is another object of the invention to provide a tubing seal divider for well tubing strings which may be unlatched by remote hydraulic control.

It is another object of the invention to provide a hydraulic tubing seal divider which is casing pressure responsive.

It is another object of the invention to provide a tubing seal divider which is run at a mid-position and thereafter hydraulically released for longitudinal expansion or contraction of the coupled tubing strings.

In accordance with the invention, there is provided a hydraulic release tubing seal divider for coupling upper and lower tubing string sections together including a first inner tubing or housing portion having an external annual latch recess thereon, a second middle tubing or housing portion sized to telescope over the inner tubing portion, a radially removable lock segment carried by the middle portion and moveable between an inner position for locking the inner and middle portions together and an outer position for releasing the two portions for relative longitudinal movement, a third outer tubing or housing portion around the second portion having an internal release access to allow the lock segment to move radially outwardly while retaining the lock segment in the second tube portion, an annular casing pressure responsive piston for moving the third tube portion relative to the second tube portion to align the release recess with the lock segment for release of the lock segment from the first tube portion, and a latch for locking the third tube portion at the release position. In one form of the device a lower inner tubing string is connected to a packer while the upper outer tubing string extends to the surface. In the other form of the invention, a lower outer tubing string is connected with the packer while an inner upper tubing string extends to the surface.

Figure 2A:
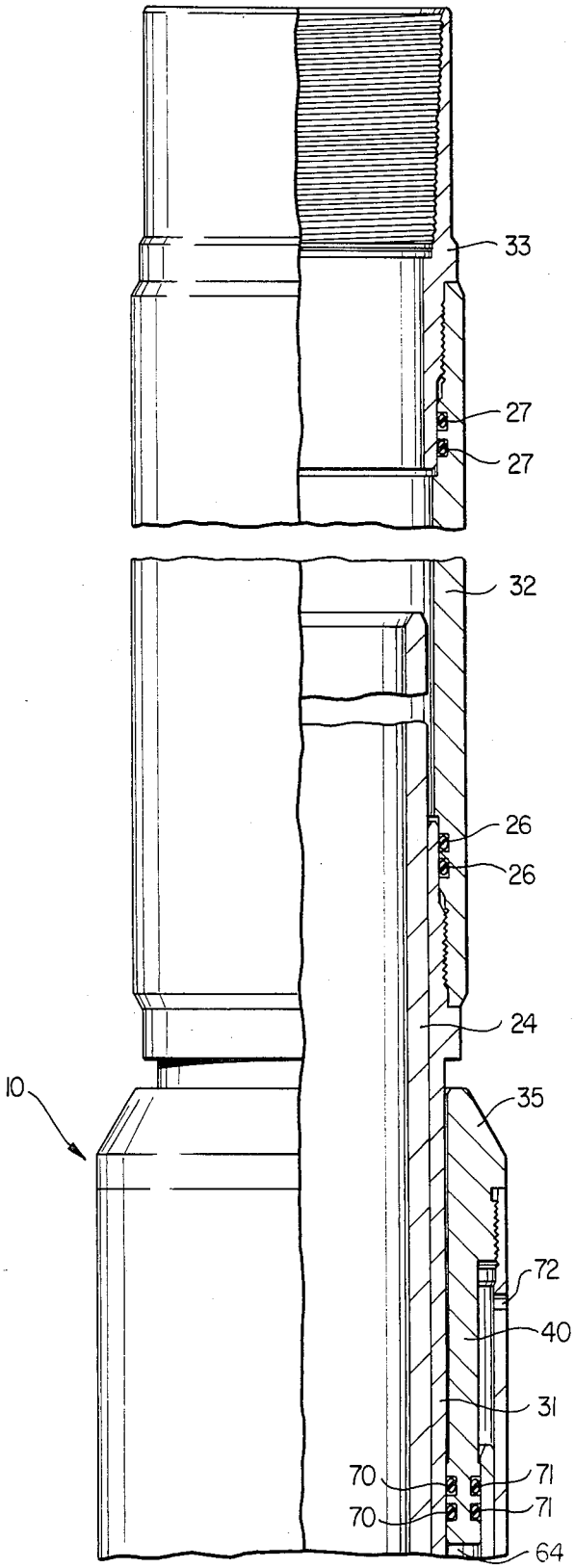
Figure 2B:
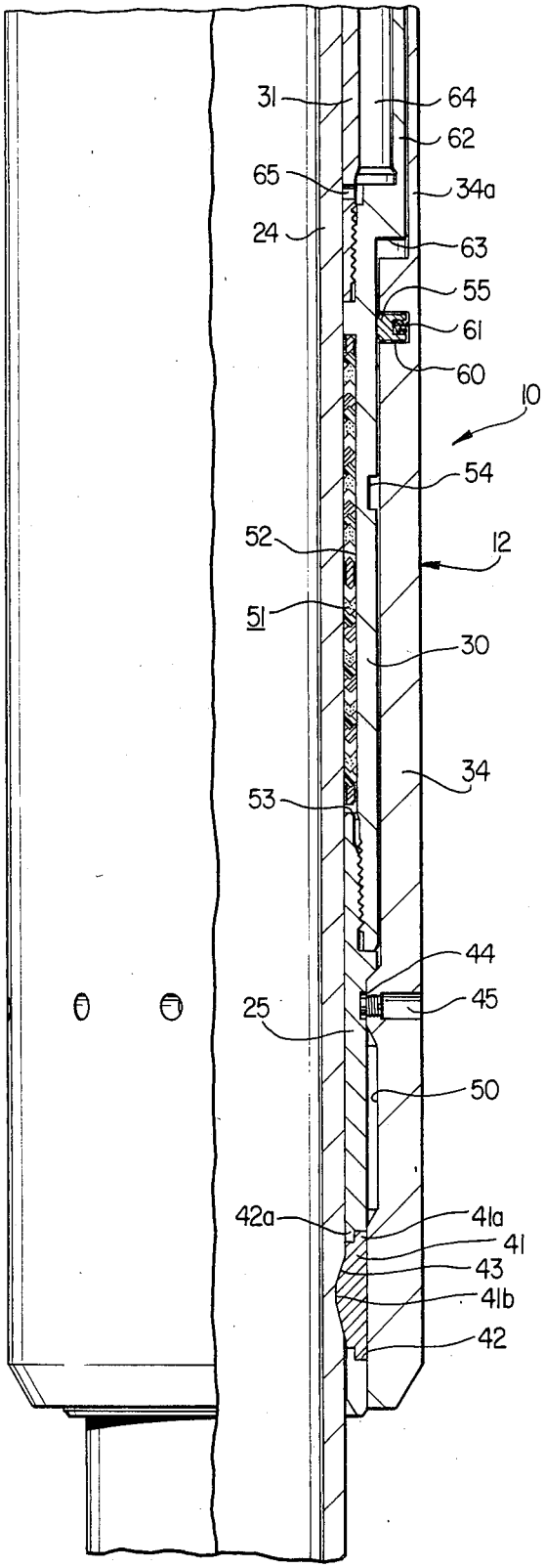
Figure 2C:
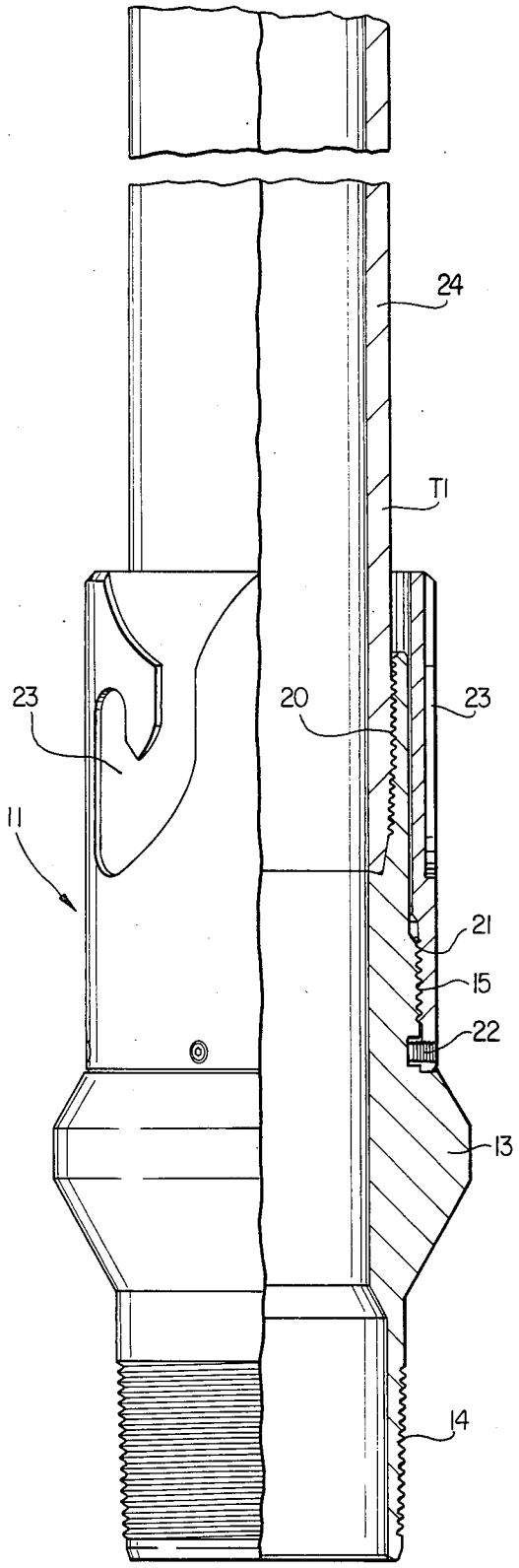
Figure 3:
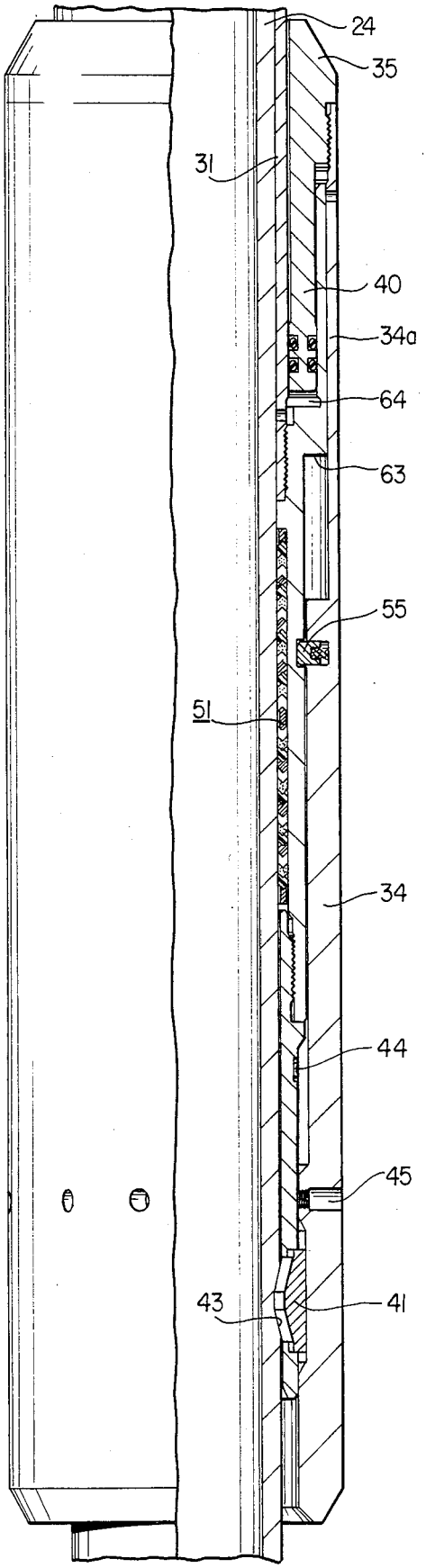
Figure 4A:
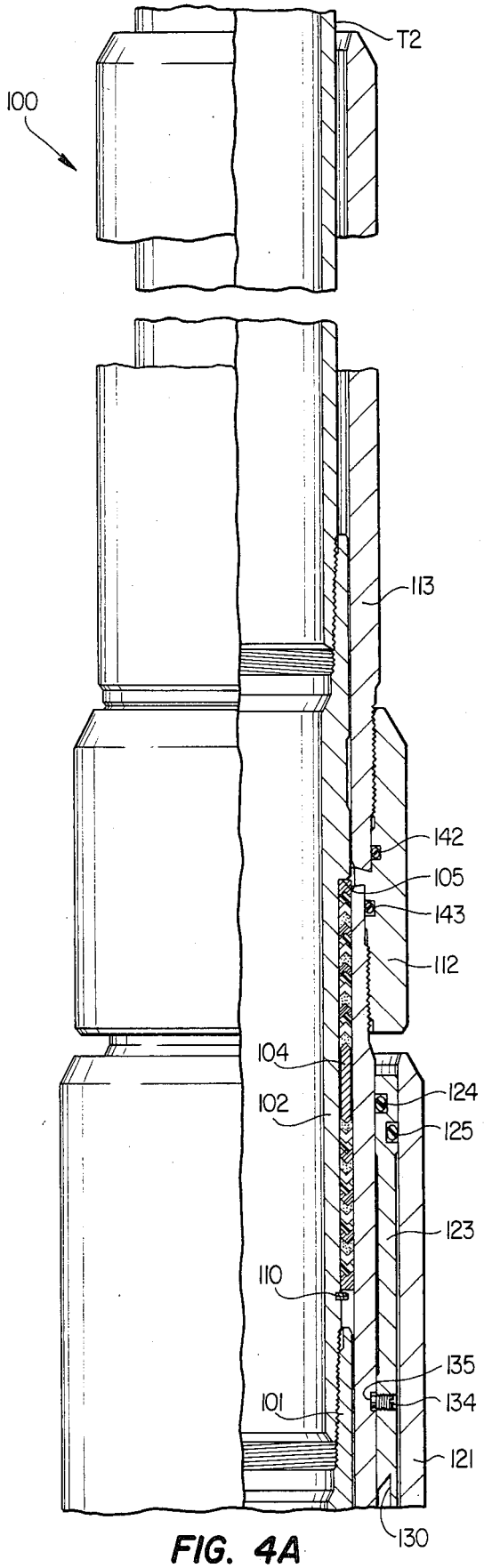
Figure 4B:
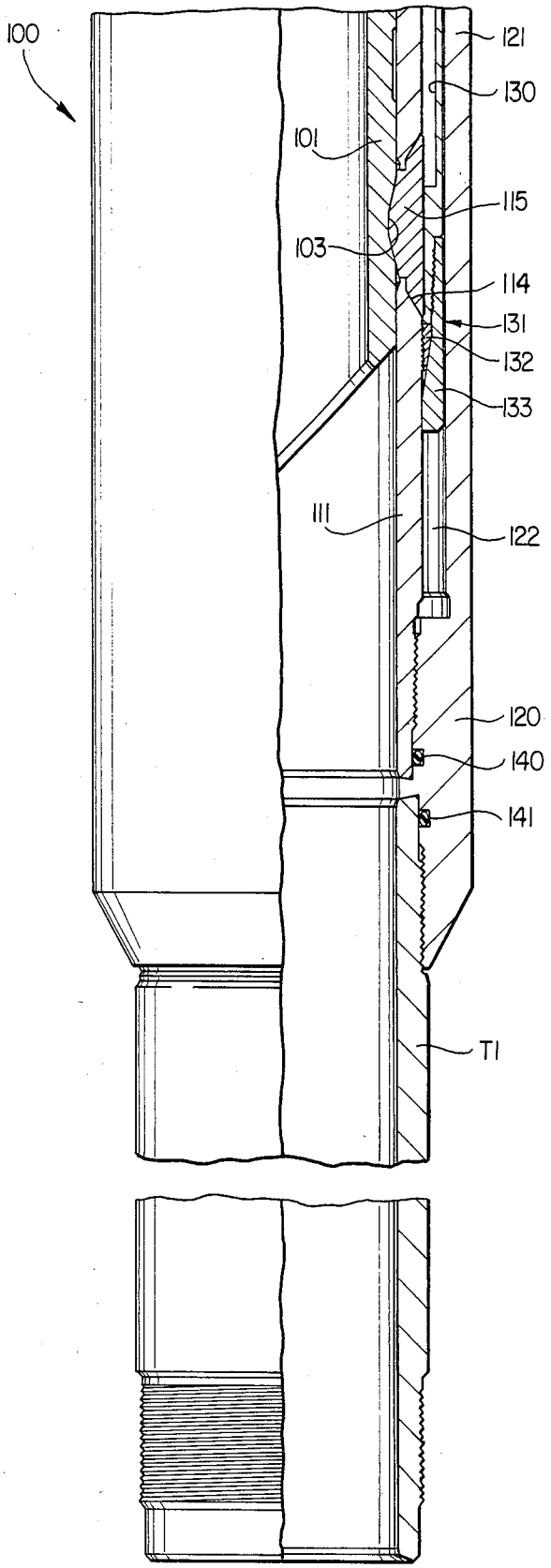
Figure 5:
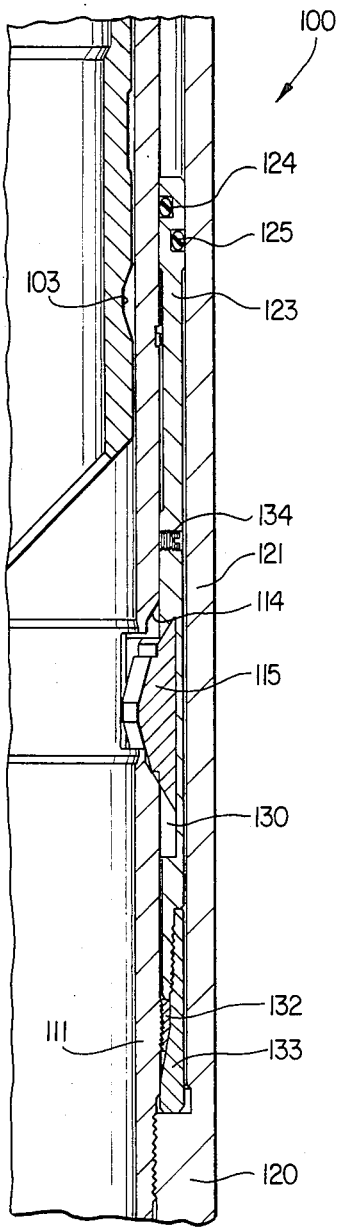

The foregoing objects and advantages of the invention will be better understood from the following detailed description of preferred embodiments of the invention taken in conjunction with the accompanying drawings wherein:

FIG. 1 is a fragmentary longitudinal schematic view in the section and elevation of a cased well bore equipped with a packer and lower and upper tubing strings connected together by a hydraulic tubing seal divider embodying the features of the invention;

FIGS. 2A–2C form a longitudinal view in section and elevation of one embodiment of the invention at a latched mid-position wherein the lower inner tubing string section is connected to the well packer;

FIG. 3 is a longitudinal view in section and elevation illustrating the tubing seal divider of FIGS. 2A–2C in a released condition;

FIGS. 4A–4B form a longitudinal view in section and elevation of another form of seal divider embodying the features of the invention in a latched mid-position v the outer tubing string extending to the packer and the inner tubing string to the surface; and FIG. 5 is a fragmentary view in section and elevation showing the tubing seal divider of FIGS. 4A–4B in a released condition.

Referring to FIG. 1, a well W having a casing C provided with perforations O is fitted with a packer P sealing with the inner casing wall around a string of lower tubing T1. A hydraulic release tubing seal divider 10 embodying the features of the invention is connected with the lower tubing string by a fishing head 11 provided with external J-slots for connection of an overshot type fishing tool for pulling the lower tubing and packer. The tubing seal divider 10 releasably couples the lower tubing T1 with an upper tubing string T2 extending to the surface. The well production system including the packer P, and the upper and lower tubing strings T1 and T2 are run into the well and the packer set with the tubing strings coupled together by means of the tubing seal divider. The tubing seal divider may then be operated hydraulically to release the connection formed by the seal divider between the lower and upper tubing string sections for telescoping the upper section relative to the lower section for spacing out and to permit expansion and contraction of the tubing strings to be accommodated by the telescoping action at the seal divider. The latch system of the seal divider is actuated by the fluid pressure in the annulus between the tubing strings and the well casing C. Such annulus pressure is applied to the well W through the wellhead, not shown, at the surface end of the well.

Referring to FIG. 2C, the fishing head 11 includes a tubular body 13 having a lower threaded portion 14 for connection into the lower tubing string T1, or directly with the mandrel of the packer P, not shown. The upper end portion of the body 13 has external threads 15 and internal threads 20. A J-slot sleeve 21 is connected on the body by the threads 15 and locked against unthreading by set screws 22. The sleeve has circumferentially spaced J-slots 23 for engagement of internal lugs in an overshot, not shown, for grasping the fishing head to retrieve the lower tubing string and packer to the surface. The lower tubing string T1 above the fishing head is connected into the body of the fishing head at the threads 20.

Referring to FIGS. 2A and 2B, the tubing seal divider 10 includes a first internal tubular housing member 24 which forms an integral section of the lower tubing string T1. The upper end of the lower tubing string T1 as seen in FIG. 2A, is provided with a landing nipple profile, not shown, for landing and locking a plug in the upper end of the lower tubing string when the upper tubing string is removed from the well. Thus, the portion of the lower tubing string T-1 illustrated in FIGS. 2A and 2B performs the dual function of both an integral part of the inner lower tubing string and the inner tubular housing member of the tubing seal divider 10. The seal divider 10 has a second middle tubular housing assembly formed by a lower tubular latch section 25, intermediate sections 30 and 31, and an upper end section 32. The housing sections 25, 30, 31, and 32 are secured together in end-to-end array by threaded connections. A pipe coupling 33 connected into the upper end of the housing section 32 provides for the connection of the upper tubing string T2 into the tubing seal divider. The middle housing assembly including the sections 25, 30, 31, and 32 are in telescoping slidable relation on the first inner housing member 24 to provide the desired longitudinal stroke or spacing out capability of the seal divider which, in the particular embodiment shown, is approximately 20 feet. The tubing seal divider has a third outer housing assembly formed by a tubular section 34 and a tubular section 35 which includes an integral annular hydraulic piston 40 for hydraulic operation of the seal divider. The housing sections 34 and 35 are secured together in tandem by a threaded connection. The outer housing assembly is slidable on the middle housing assembly between the locking position shown in FIGS. 2A and 2B and a release position illustrated in FIG. 3. Referring to FIG. 2B, one or more lock segments 41, are carried by the middle housing section 25 in windows 42 provided in the housing section. The windows 42 are shaped to define an annular retainer flange 42*a* which engages a retainer flange 41*a* on the lock segment 41 to prevent the lock segments from falling inwardly when the inner housing section 24 is not present within the middle housing assembly, such as during removal of the upper tubing string from the well. The inner housing member 24 has an external annular locking recess 43 engageable by internal locking bosses 41*b* on the lock segments 41, as shown in FIG. 2B, for locking the middle housing assembly against longitudinal movement on the inner housing member. The middle housing section 25 has circumferentially spaced blind shear pin holes or sockets 44 formed in the outer surface of the housing section for the inward ends of shear pins 45 connected through the outer housing section 34 into the sockets to hold the outer section at the lock position on the middle housing assembly as illustrated in FIG. 2B. The outer housing section 34 has an internal annular release recess 50 which is sized to receive the outer portions of the lock segments 41 to release the lock segments from the inner housing section 24 when the outer section 34 is shifted to the release position on the middle housing assembly as illustrated in FIG. 3. As shown in FIG. 2B, an annular seal assembly 51 is fitted in an internal annular recess 52 in the middle housing section 30 held in the recess by the upper end edge 53 of the housing section 25. The seal assembly 51 seals between the telescoping members of the tubing seal divider housing over the length of the 20 foot stroke of the tubing seal divider. The middle housing section 30 has an external annular latch recess 54 engageable by the latch ring 55 carried in an internal annular recess 60 in the outer housing section 34 and biased inwardly by springs 61. The latch ring 55 holds the outer housing assembly at the release position on the middle housing section 30 as illustrated in FIG. 3. The middle housing section 30 has an enlarged upper end section providing a skirt portion 62 and a stop flange 63 on the lower end of the skirt portion. The skirt portion 62 is spaced from the outer surface of the middle housing section 31 defining an annular hydraulic cylinder 64 in which the annular piston 40 is operable. A bleed port 65 through the middle housing section 31 opens into the lower end of the cylinder 64. The piston 40 has internal ring seals 70 sealing between the piston and the outer surface of the housing section 31 and external ring seals 71 sealing with the inner wall of the skirt portion 62. The outer housing section 34 has an upwardly extending skirt portion 34*a* having a threaded connection at the upper end thereof with the housing section 35 which includes the integral annular piston 40. The skirt portion 34*a* fits in sliding relation over the skirt portion 62 and is spaced around the piston 40 to permit the skirt portion 62 to fit between the piston and the outer skirt portion 34*a*. The skirt portion 34*a* extending to the body section 35 above the skirt portion 62 defines the outer wall of the annular cylinder 64 above the ring seals 71. A bleed port 72 is provided in the skirt portion 34*a* to release fluid from the cylinder 64 above the annular piston 40 for operating the tubing seal divider between the locked condition and the released condition. The piston 40 is spaced around the housing section 31 above the ring seals to permit free movement of the piston 40 along the housing section 31 when operating the annular piston 40 to release the lock segments 41 for spacing out the tubing sections T1 and T2.

Ring seals 26 in internal annular recesses in the housing section 32 seal between the housing section 31 and the housing section 32. Similarly, ring seals 27 carried by the housing section 32 seal between the upper end portion of the housing section 32 and the upper end connector 33.

In operation, the tubing seal divider 10 is assembled in the locked condition illustrated in FIGS. 2A–2C and connected between the lower tubing string section T1 and the upper tubing string section T2. The packer P is connected on the lower tubing string T1 by the J-latch coupling assembly 11. The tubing string upper and lower sections, the tubing seal divider, and the packer are run into the well and the packer is set in the well in the position illustrated schematically in FIG. 1. In the locked condition of the tubing seal divider, as particularly seen in FIG. 2B, the lock segments 41 engage the lock recess 43 in the inner housing section 24. The outer housing section 34 is locked against longitudinal movement on the housing section 25 by the shear pins 45 in the position at which the release recess 50 is spaced above the lock segments 41 so that the bore of the housing section 34 below the recess 50 holds the lock segments 41 at the inward positions at which the inner bosses 41*b* of the lock segments engage the lock recess 43 so that the middle housing section 25 and the outer housing section 34 which are locked against relative movement cannot move longitudinally on the inner housing section 24. Thus, as the tubing strings and packer are lowered, the tubing seal divider 10 cannot be extended or retracted but rather remains locked as shown in FIGS. 2A–2C. With the tubing seal divider locked, the packer P is set as represented in FIG. 1. The tubing seal divider is then hydraulically operated to release the upper and lower tubing strings for spacing out and to accommodate expansion and contraction of the tubing strings. The seal divider is released by hydraulic pressure applied through the well annulus downwardly within the casing C around the tubing strings above the packer P. The annulus pressure is communicated to the piston 40 through the port 72 and within the piston in the space between the piston and the housing section 35 above the ring seals 70 and 71. When the hydraulic pressure on the piston 40 from the fluid in the annulus exerts a downward force on the piston which exceeds the holding ability of the shear screws 45, which may, for example, be about 30,000 pounds, the inward ends of the shear screws in the recesses 44 shear releasing the outer housing assembly including the sections 34, 35, and the integral piston 40 for downward movement on the middle housing assembly along the housing sections 25, 30, and 31. As the piston 40 is pumped downwardly, the outer housing section 34 with the skirt 34*a* is telescoped downwardly until the latch ring 55 in the section 34 is aligned with the latch recess 54 around the middle housing section 30. The springs 61 urge the latch ring 55 into the recess 54 locking the housing section 34, the skirt 34*a*, and the housing section 35 with piston 40 at the lower release position at which the release recess 50 is aligned with and around the lock segments 41 which are now free to move radially outwardly into the recess 50 out of the inner housing section recess 43. With the lock segments 41 released for outward movement, the lock elements are cammed outwardly by any longitudinal movement of the upper tubing string T2 which is connected into the upper end of the middle housing assembly at the section 32. Thus, with the lock segments 41 released, the upper tubing string T2 is free to expand and contract the full stroke permitted by the design of the system. With the outer housing assembly latched at the lower release position by the ring 55, the middle housing assembly including the sections 25, 30, 31, and 32 move as a unit with the upper tubing string and the outer housing assembly including the section 34 with the skirt 34A and the section 35 and the piston 40 being latched to the middle housing assembly move with the middle housing assembly the full stroke of the tubing seal divider. Over the full stroke of the device, the seal assembly 51 seals the telescoping joint formed by the seal divider between the lower tubing string T1 and the upper tubing string T2.

A particularly important feature of the invention is that the tubing seal divider is pinned at a mid-position while the packer and the tubing string assembly are run into the well, and thus when the seal divider is activated releasing the lock segments 41, the lower end of the upper tubing string is free to move both upwardly and downwardly. This is in contrast with prior art arrangements where the seal divider is run in the closed position and when opened the upper tubing string is free to move upwardly only.

If conditions develop which require the removal of the upper tubing string P2, the tubing string is pulled raising the seal divider 10 including all of the components of the seal divider other than the first inner housing section 24 which is an integral part of the lower tubing string T1. The upper tubing string T2 along with the seal divider middle and outer housing assemblies are removed from the well leaving the lower tubing string T1 in the well connected into the packer by the J-latch coupling assembly 11. If conditions require, a plug, not shown, may be set in the landing nipple profile, not shown, at the upper end of the tubing string T1 prior to removal of the upper tubing string with those portions of the tubing seal divider connected with the lower end of the upper tubing string at the coupling 33. The lower tubing string and the packer remain set in the well. The lower tubing string and the packer may be removed, if desired, by using standard well tools and techniques including an overshot which telescopes downwardly over the J-latch assembly 11 engaging the J-latch recesses 23 for coupling with the lower tubing string and packer.

The tubing seal divider 10 is not designed to relatch in the well bore. Once the outer housing assembly is telescoped downwardly and latched at the lower release position by the ring 55, the outer housing assembly remains in the release position at which the lock segments 41 are free to move outwardly and cannot again lock with the inner housing section 24 on the lower tubing string T1.

Referring to FIGS. 4A–4B, another form of hydraulic release tubing seal divider 100 provides a telescoping connection between the lower tubing string T1 and the upper tubing string T2 in the well system schematically illustrated in FIG. 1. The primary difference in the seal divider 100 and the seal divider 10 is that when using the seal divider 100 the middle and outer housing assemblies remain connected with the lower tubing string tube T1 while the inner housing assembly is connected with the lower end of the upper tubing string T2 and telescopes with and is removable with the upper tubing string. The seal divider 100 has a tubular inner housing assembly including a lower end latch section 101 threaded on the lower end of a seal section 102 which is connected by threads to the lower end of the upper tubing string T2. The section 101 has an external annular lock recess 103. A seal assembly 104 is mounted on the housing section 102 between a stop shoulder 105 and snap rings 110. The seal divider has a middle housing assembly including a tubing section 111, a connector 112, and a tubing section 113, which also form an integral upper end section of the lower tubing string T1. The tubing section 111 had one or more windows 114 shaped to receive a lock segment 115, illustrated at the inward locked position in FIG. 2B. The tubing seal divider 100 has an outer housing assembly which includes a coupling member 120 provided with an upwardly extending cylinder wall portion 121 spaced from the middle housing assembly section 111 defining an upwardly opening annular cylinder 122. An annular piston 123 is mounted for sliding in the cylinder 122 for hydraulically operating tubing seal divider 100. The piston 123 has internal and external ring seals 124 and 125 for sealing between the piston and the middle housing section 111 and the cylinder wall portion 121. The lower end portion of the piston 123 forms a release skirt having an internal annular release recess 130 which is sized and shaped to receive the lock segments 115 when the recess is aligned with the lock segments to permit the lock segments to move radially outwardly out of engagement with the locking recess 103 in the inner housing section 101. An internal slip assembly 131 secured on the lower end of the release skirt of the piston 123 includes internal slips 132 and a slip retainer 133 threaded on the lower end of the piston release skirt. As shown in the FIG. 4B, the piston 123 is held in the upper release position by shear screws 134 threaded through the piston engaging shear screw sockets or a blind holes 135 in the outer face of the middle housing section 111.

Ring seals 140 and 141 the seal between the housing coupling section 120 and the housing innersection 111 and the upper end of the lower tubing string T1, respectively. Similarly, the ring seals 142 and 143 seal between the middle housing section 112 and the housing sections 113 and 111, respectively.

In operation, the tubing seal divider 100 is connected between the lower and upper tubing strings T1 and T2 as illustrated in FIGS. 4A–4B. The lock elements 115 in the middle housing section 111 are engaged in the recess 103 around the inner housing section 101 locking the middle housing section on the inner housing section thereby coupling the lower and upper tubing strings together by means of the tubing seal divider. It will be noted that the inner housing section 101 is engaged through the housing section 102 with the lower end of the upper tubing string T2. The lock elements 115 are in the windows 114 of the middle housing section 111 which is coupled by the outer coupling member 120 with the lower tubing string T1. The shear pins 134 in the piston 123 engage the recess 135 in the middle housing section 111 thereby locking the piston against movement. The tubing strings T1 and T2 connected together by the tubing seal divider 100 are run into a well bore as generally described in connection with the well system of FIG. 1. After the well system is completed as illustrated in FIG. 1, the tubing seal divider 100 is operated to release the upper tubing string T2 from the lower tubing string T1 for spacing out functions and for compensating for extensions and contractions of the tubing of the tubing strings due to temperature changes in the well bore along the strings. Hydraulic pressure in the well annulus is communicated to the piston 123 above the seals 124 and 125 through the upper end of the cylinder wall section 121 of the housing. When the hydraulic pressure is sufficiently high, the pins 134 are sheared releasing the piston 123 which is forced downwardly to the lower end position of FIG. 5 at which the release recess 130 is aligned with the lock segments 115 which are released to move outwardly out of the locking recess 103 around the inner housing section 101. The outward movement of the lock segments 115 releases the inner housing section and the upper tubing string T2 from the middle housing section 111 and the lower tubing string T1. The piston and release skirt portion of the piston including the recess 130 are locked at the lower release position by the internal slips 132 which engage the outer surface of the middle housing section 111 preventing return of the piston 123 to the upper locked position. With the lock segments 115 in the outer release positions, the tubing string T2 along with the inner housing sections 101 and 102 and the seal assembly 104 may be telescoped upwardly or downwardly within the lower tubing string T1 including the middle housing section 111 and the section of tubing 113 at the upper end of the lower tubing string T1.

The tubing seal divider 100 is preferably arranged to lock the upper tubing string T2 at a relative mid position with the lower tubing string T1 when run into the well so that the upper tubing string 2 may move upwardly and downwardly approximately one-half of the full stroke permitted, which may, for example, be twenty feet. Thus, the tubing seal divider 100 permits running upper and lower tubing strings connected together such that the strings may move in either direction after release, in contrast with some prior devices which require that the tubing seal divider be run locked together at the closed position thus allowing movement of the tubing strings in only one direction.

Using the tubing seal divider 100, when removal of the upper tubing string T2 is desired, the string is pulled from the wellbore telescoping the upper tubing string upwardly from the lower tubing string T1 and the connected components of the tubing seal divider which remain secured with the lower tubing string. More particularly, when the upper tubing string T2 is pulled, the tubing seal divider inner housing sections 101 and 102 along with the seal assembly 104 remain connected with the lower end of the upper tubing string. Similarly, the middle and outer housing assemblies of the tubing seal divider 100 remain in the well connected with the upper end of the lower tubing string T1. Specifically, the middle housing section 111 with the coupling 112 and the upper end section 113 together with the outer housing section 120, the piston 123, and related members remain in the well connected with the lower tubing string.

What is claimed:

1. A hydraulic release tubing seal divider for coupling an upper tubing string in telescopic relation with a lower tubing string and releasing the tubing strings in a wellbore for relatively longitudinal movement therein comprising: a first inner housing assembly connectable with a first of said tubing strings to define an integral length of said first of said tubing strings, said first housing assembly having an external lock recess located on said assembly and said assembly being configured to permit longitudinal movement of said first housing assembly over the length of a predetermined stroke relative to the second of said tubing strings; and second and third housing assemblies in concentric relation on said first housing assembly and connectable to said second tubing string to provide telescoping relation between said first and said second tubing strings, including lock means for engaging said lock recess on said first housing assembly to lock said first housing assembly with said second and third housing assemblies, a hydraulic piston, lock means holding and lock means release means connected with said piston for operating said lock means between lock and release conditions; releasable means for holding said piston in lock condition; means for holding said piston in release condition; and means for sealing between said first and second tubing strings during relative telescopic movement of said tubing strings over said predetermined stroke.

2. A hydraulic release tubing seal divider in accordance with claim 1 wherein said first housing assembly is connected with said lower tubing string and said second and third housing assemblies are connected on said upper tubing string.

3. A hydraulic release tubing seal divider in accordance with claim 2 where said lock means is a lock segment positioned in a section of said second housing assembly and said lock means holding and release means comprises a section of said third housing assembly connected with said piston and having a holding surface engaged with said lock segment at said lock condition and spaced therefrom a release recess aligned with said lock segment to permit outward movement of said lock segment at said release condition.

4. A hydraulic release tubing seal divider in accordance with claim 3 wherein said means for holding said piston in a lock condition comprises a shear pin means between said second and said third housing assemblies.

5. A hydraulic release tubing seal divider in accordance with claim 3 wherein said means for holding said piston in lock release condition comprises a latch ring in one of said second and third housing assemblies and a latch recess in the other of said second and third housing assemblies for receiving said latch ring at said lock condition and holding said third housing assembly against longitudinal movement on said second housing assembly.

6. A hydraulic release tubing seal divider in accordance with claim 1 wherein said first housing assembly is connected with and forms an integral part of said upper tubing string and said second and third housing assemblies are connected with said lower tubing string.

7. A hydraulic release tubing seal divider in accordance with claim 6 wherein said lock means is a lock segment radially moveable in a window provided in a section of said second housing assembly and said lock means holding and lock means release means comprises a sleeve secured with said piston, said sleeve having a holding surface around said lock segment in said lock condition and having an internal recess spaced from said lock surface and alignable with said lock segment in said release condition.

8. A hydraulic release tubing seal divider in accordance with claim 7 wherein said means for holding said piston in lock condition comprises shear pin means between said piston and a section of said second housing assembly releasable locking said piston in lock condition.

9. A hydraulic release tubing seal divider in accordance with claim 8 wherein said means for holding said piston in lock release condition comprises internal slips and an internal slip retainer connected with said piston for engaging a section of said second housing assembly to lock said piston against movement on said second housing assembly after said piston is moved to the lock release condition.

10. A hydraulic release tubing seal divider for telescopically coupling an upper tubing string with a lower tubing string and releasing the coupling in a wellbore for relative longitudinal movement of the tubing strings in telescopic relationship comprising: an inner housing section defining a central flowpath through said seal divider and connectable at one end with a first of said tubing strings to form an integral part thereof, said inner housing section having a lock segment recess formed in the outer surface thereof; a middle housing assembly positioned in concentric sliding relation on said inner housing section, said middle housing assembly having at least one lock segment window alignable with said lock recess in said inner housing section, shear pin sockets spaced from said window, a latch recess spaced from said shear pin sockets, and annular end skirt means defining an annular hydraulic cylinder; a radially movable lock segment in said window of said middle housing assembly; an internal annular seal assembly in said middle housing assembly for sealing between said middle housing assembly and said inner housing section; a third outer housing assembly in concentric slidable relation on said middle housing assembly including a lock and release section and a piston section, said piston section being movable in said annular cylinder of said middle housing assembly and said lock and release section having an annular internal lock surface alignable over said lock segment at a lock position and an internal release recess alignable over said lock segment at a release position; shear pin means through said lock and release section engageable with said shear pin socket means in said middle housing assembly at said lock position of said lock and release section on said middle housing assembly; a latch ring in said lock and release section engageable with said latch recess on said lock and release section at said release position of said lock and release section; and the outer surface of and said lock recess on said inner housing section being arranged to permit relative telescopic movement between said inner housing section and said middle and outer housing assemblies in either direction over a defined stroke length when said middle and outer housing assemblies are released from said inner housing section.

11. A hydraulic release tubing seal divider in accordance with claim 10 wherein said first inner housing section is connectable with a lower tubing string extending to a well packer and said middle and said outer housing assemblies are connectable on the lower end of an upper tubing string and removable therewith.

12. A hydraulic release tubing seal divider for telescopically coupling an upper tubing string with a lower tubing string in a well comprising: an inner tubular housing assembly connectable with an end of one of said tubing strings forming an integral section thereof, said inner housing assembly having an external annular lock recess thereon; an external annular seal assembly mounted on said inner housing assembly; a middle housing assembly connectable on the other of said tubing strings and fitting in telescopic relation on said inner housing assembly and including a concentric spaced lock and release section and a concentric annular cylinder wall section defining an annular hydraulic cylinder with said lock and release section, said lock and release section being provided with a lock element window and with a shear pin recess in the outer surface thereof; a lock segment in said window of said lock and release section of said middle housing assembly for radial movement between lock and release positions relative to said lock recess on said inner housing assembly; and a third housing assembly slidable in said middle housing assembly including an annular piston in said annular cylinder of said middle housing assembly and a lock and release section connected with said annular piston, said lock and release section having an internal release recess alignable with said lock segment in said middle housing assembly and an internal slip assembly engageable with said middle housing assembly when said annular piston and integral lock and release section is aligned at release position with said inner housing assembly and said lock segment; and said inner housing assembly with said release recess and said seal assembly being arranged to move telescopically in said middle housing assembly in either direction when said third housing assembly is at said release position.

* * * * *